US010344707B2

(12) United States Patent
Loew et al.

(10) Patent No.: US 10,344,707 B2
(45) Date of Patent: Jul. 9, 2019

(54) PISTON FOR A TWO-STROKE ENGINE OPERATING WITH ADVANCED SCAVENGING AND A TWO-STROKE ENGINE

(71) Applicant: Andreas Stihl AG & Co. KG, Waiblingen (DE)

(72) Inventors: Birger Loew, Wernau (DE); Jonas Lank, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 4 days.

(21) Appl. No.: 15/682,343

(22) Filed: Aug. 21, 2017

(65) Prior Publication Data

US 2018/0051649 A1 Feb. 22, 2018

(30) Foreign Application Priority Data

Aug. 19, 2016 (EP) ..... 16001824

(51) Int. Cl.
*F02B 25/00* (2006.01)
*F02F 3/24* (2006.01)
*F02F 3/00* (2006.01)

(52) U.S. Cl.
CPC ..... *F02F 3/24* (2013.01); *F02F 3/0076* (2013.01)

(58) Field of Classification Search
CPC ..... F02F 3/24; F02F 3/0078
USPC ..... 123/193.6
See application file for complete search history.

(56) References Cited

U.S. PATENT DOCUMENTS 5,979,391 A 11/1999 Ulrich et al.
7,406,941 B2 * 8/2008 Zhu ..... F02F 3/0084 123/193.6
8,616,164 B2 * 12/2013 Kunert ..... F02B 25/14 123/193.6
8,899,194 B2 12/2014 Engel
2007/0113734 A1 5/2007 Haussermann et al.
2010/0147252 A1 * 6/2010 Langner ..... F02F 3/027 123/193.6
2011/0197868 A1 8/2011 Engel
2013/0192556 A1 * 8/2013 Rothkegel ..... F02F 3/0076 123/193.6
2014/0182571 A1 7/2014 Takayanagi et al.
2015/0059682 A1 * 3/2015 Weinenger ..... F02F 3/0092 123/193.6

(Continued)

FOREIGN PATENT DOCUMENTS

JP S55170440 U 12/1980
JP S6055753 A 4/1985

(Continued)

*Primary Examiner* — Marguerite J McMahon
(74) *Attorney, Agent, or Firm* — Walter Ottesen, P.A.

(57) ABSTRACT

A piston for a two stroke engine which operates with advanced scavenging has a piston base and a piston skirt. The center axis of the piston skirt forms a longitudinal center axis of the piston. The piston has two piston pin eyes, in which piston pin receptacles are configured. The center axis of the piston pin receptacles forms a transverse axis of the piston. The piston has at least one piston pocket. At least one piston pin eye is connected via at least one connecting rib to the piston skirt. Here, the connecting rib runs on that side of the piston pocket which faces away from the piston base.

17 Claims, 4 Drawing Sheets

(56) References Cited

U.S. PATENT DOCUMENTS

| | | | | |
|---|---|---|---|---|
| 2015/0198114 | A1* | 7/2015 | Zauner ..... | F02F 3/08<br>123/294 |
| 2016/0097344 | A1 | 4/2016 | Yamazaki et al. | |

FOREIGN PATENT DOCUMENTS

| | | | |
|---|---|---|---|
| JP | H03119553 | U | 12/1991 |
| JP | H08117917 | A | 5/1996 |

* cited by examiner

PISTON FOR A TWO-STROKE ENGINE OPERATING WITH ADVANCED SCAVENGING AND A TWO-STROKE ENGINE

CROSS REFERENCE TO RELATED APPLICATION

This application claims priority of European patent application no. 16 001 824.8, filed Aug. 19, 2016, the entire content of which is incorporated herein by reference.

FIELD OF THE INVENTION

The invention relates to a piston for a two stroke engine of the stated type which operates with advanced scavenging, and to a two stroke engine.

BACKGROUND OF THE INVENTION

U.S. Pat. No. 8,899,194 has disclosed a piston for a two stroke engine which operates with advanced scavenging, which piston has piston pockets which serve to connect an air inlet which opens at the cylinder bore to transfer windows of transfer channels. Air from the air inlet is advanced in the transfer channels via the piston pockets. A multiplicity of deepenings are provided on the piston skirt of the piston.

SUMMARY OF THE INVENTION

It is an object of the invention to provide a piston for a two stroke engine which operates with advanced scavenging, which piston has high stability. It is a further object of the invention to specify a two stroke engine having a piston.

With regard to the piston, the object can, for example, be achieved by way of a piston for a two stroke engine which operates with advanced scavenging, the piston having a piston base and a piston skirt, the center axis of the piston skirt forming a longitudinal center axis of the piston, the piston having two piston pin eyes, in which piston pin receptacles are configured, the center axis of the piston pin receptacles forming a transverse axis of the piston, the piston having a center plane which contains the longitudinal center axis of the piston which runs perpendicularly with respect to the transverse axis of the piston, the piston having at least one piston pocket, at least one piston pin eye being connected via at least one connecting rib to the piston skirt, the connecting rib running on that side of the piston pocket which faces away from the piston base. With regard to the two stroke engine, the object can, for example, be achieved by way of a two stroke engine having a piston, the two stroke engine having a cylinder, in the cylinder bore of which a combustion chamber is configured which is delimited by the piston, the piston driving a crankshaft which is mounted rotatably in a crankcase, the two stroke engine having at least one transfer channel which, in at least one position of the piston, connects a crankcase interior of the crankcase to the combustion chamber, and the two stroke engine having an air channel for feeding in advanced scavenging air, which air channel opens with an air inlet on the cylinder bore, the cylinder pocket lying at least partially in congruence with the air inlet and the transfer window of a transfer channel in at least one position of the piston.

The piston has piston pin eyes, in which piston pin receptacles are configured. It is provided that at least one piston pin eye is connected to the piston skirt via at least one connecting rib. Here, the connecting rib runs on that side of the piston pocket which faces away from the piston base. The connecting rib leads to improved support of the piston pin eye. Forces from the piston pin eye can be transmitted to the piston skirt via the connecting rib in an improved manner. This achieves higher stability. The introduction of force from the piston pin eye into the piston skirt is improved. The connecting rib brings about stiffening and an increase in the strength of the piston. Heat from the piston pin eye is also dissipated into the piston skirt via the connecting rib. This achieves improved cooling of the thermally particularly highly loaded region of the piston pin eyes.

A deepening is advantageously configured between the connecting rib and the piston skirt. The deepening avoids material accumulations in this region, with the result that there is an improved manufacturing capability of the piston, in particular in a casting process. Casting faults can be avoided by way of the deepening. A reduction in weight is achieved. The depth of the deepening is advantageously at least 3%, in particular at least 5% of the height of the piston. Satisfactory cooling of the connecting rib on both sides by way of mixture which flows in the crankcase interior and/or by way of combustion air which flows in the crankcase interior is achieved via the deepening. The depth of the deepening is advantageously less than 20% of the height of the piston. Sufficient installation space remains for the piston pocket as a result, without the overall height of the piston being increased. A sufficiently large piston pocket ensures that a sufficient quantity of advanced scavenging air is advanced in the transfer channels, with the result that low exhaust gas values of a two stroke engine which operates with the piston can be achieved. The connecting rib advantageously runs approximately parallel to the center plane of the piston. The spacing of the connecting rib from the center plane, which spacing is measured perpendicularly with respect to the center plane, is advantageously at least 20% of the diameter of the piston.

The piston pin eyes have end sides which face one another. The connecting rib is advantageously at a spacing from the end side of the associated piston pin eye, which spacing is measured parallel to the transverse axis and has at least 5%, in particular at least 10% of the diameter of the piston. Accordingly, in the state in which it is installed in the two stroke engine, the connecting rib is offset radially to the outside in relation to a cylinder longitudinal axis with respect to that end side of the piston pin eye which faces a connecting rod of the two stroke engine. Here, the piston pin eye which is assigned to a connecting rib is the piston pin eye which connects the connecting rib to the piston skirt.

The piston pocket advantageously has a rear wall. The rear wall of the piston pocket is the wall which separates the piston pocket from the interior of the piston, which interior is enclosed by the piston skirt. The connecting rib is advantageously arranged as an extension of the rear wall of the piston pocket. As a result of the arrangement of the connecting rib as an extension of the rear wall of the piston pocket, the connecting rib brings about stiffening of the rear wall of the piston pocket. The connecting rib preferably adjoins the rear wall of the piston pocket. The deepening is advantageously delimited by the piston pin eye, by the piston skirt, by the connecting rib and by the rear wall of the piston pocket.

The piston skirt advantageously has an edge which faces away from the piston base. The connecting rib has an end side which faces away from the piston base. The end side of the connecting rib advantageously does not protrude as far as the underside of the piston, but rather is offset in the direction of the piston base with respect to that edge of the piston which forms the underside of the piston. The offset between the end side of the connecting rib and the edge is advantageously less than 5% of the height of the piston in the direction of the longitudinal center axis of the piston at each point of the end side. It can also be provided that the end side of the connecting rib protrudes as far as the height of the edge. There is advantageously an offset of at least 0.5 mm between the end side of the connecting rib and the edge in the direction of the longitudinal center axis of the piston, however.

A web of the piston skirt advantageously runs between the edge and the piston pocket. In the circumferential region of the piston, in which the deepening is arranged, the web has a height which is at least 1.5 times the smallest height of the web. Accordingly, the web is of higher configuration in the region of the deepening than in other regions of the piston pocket. This achieves satisfactory guidance of the piston in the region of the deepening, and at the same time provides sufficient installation space for the deepening. During operation, the piston advantageously bears over at least a part section of the piston stroke with at least one section of the web against the cylinder bore.

The piston pin receptacle is preferably arranged at least partially, in particular completely in the piston pocket. This can achieve a low overall height of the piston and therefore a low overall height of the cylinder of a two stroke engine. At the same time, the piston pin receptacle is at a comparatively great spacing from the piston base. As a result of a comparatively great spacing between the piston pin receptacle and the piston base, the input of heat into the piston pin and therefore into the piston pin bearing, by way of which the connecting rod is mounted on the piston pin, can be reduced during operation.

The piston preferably has two piston pockets on opposite sides of the center plane, in each case one connecting rib being arranged on the two piston pin eyes. The piston pockets and the connecting ribs are preferably arranged symmetrically with respect to the center plane. An asymmetrical configuration can also be advantageous, however.

The piston is advantageously made of light metal, in particular of aluminum or magnesium. This results in a lower weight of the piston. With an identical overall weight, a two stroke engine having a piston made from light metal, in particular from magnesium, can have an engine with a greater displacement and therefore with higher performance than, for example, a two stroke engine having a piston which does not consist of light metal, in particular does not consist of magnesium. In the case of a piston made from light metal, in particular, the connecting rib affords advantages with regard to the stability of the piston, since light metal, in particular magnesium, itself has a lower strength.

The connecting rib is advantageously arranged on an outlet side of the piston between the piston pin eye and the piston skirt. In one advantageous configuration, as an alternative or in addition, at least one connecting rib is provided on an inlet side of the piston, which connecting rib connects the piston pin eye to the piston skirt. Here, a connecting rib on the inlet side is advantageously arranged and configured in a mirror-symmetrical manner with regard to a transverse plane of the piston with respect to a connecting rib on the outlet side.

A two stroke engine having a piston according to the invention advantageously has a cylinder, in the cylinder bore of which a combustion chamber is configured. The combustion chamber is delimited by the piston. The piston drives a crankshaft which is mounted rotatably in a crankcase. The two stroke engine has at least one transfer channel which, in at least one position of the piston, connects a crankcase interior of the crankcase to the combustion chamber. The two stroke engine has an air channel for feeding in advanced scavenging air, which air channel opens with an air inlet at the cylinder bore. The piston pocket lies at least partially in congruence with the air inlet and a transfer window of a transfer channel in at least one position of the piston.

Via the piston pocket, as a result, advanced scavenging air from the air channel can be fed via the air inlet into the transfer window of the transfer channel and can thus be advanced in the transfer channel. Here, the advanced scavenging air can be fuel-free or low-fuel combustion air. Low exhaust gas values are achieved as a result.

The features of the embodiments can be combined with one another in any desired way, in order to form advantageous embodiments.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
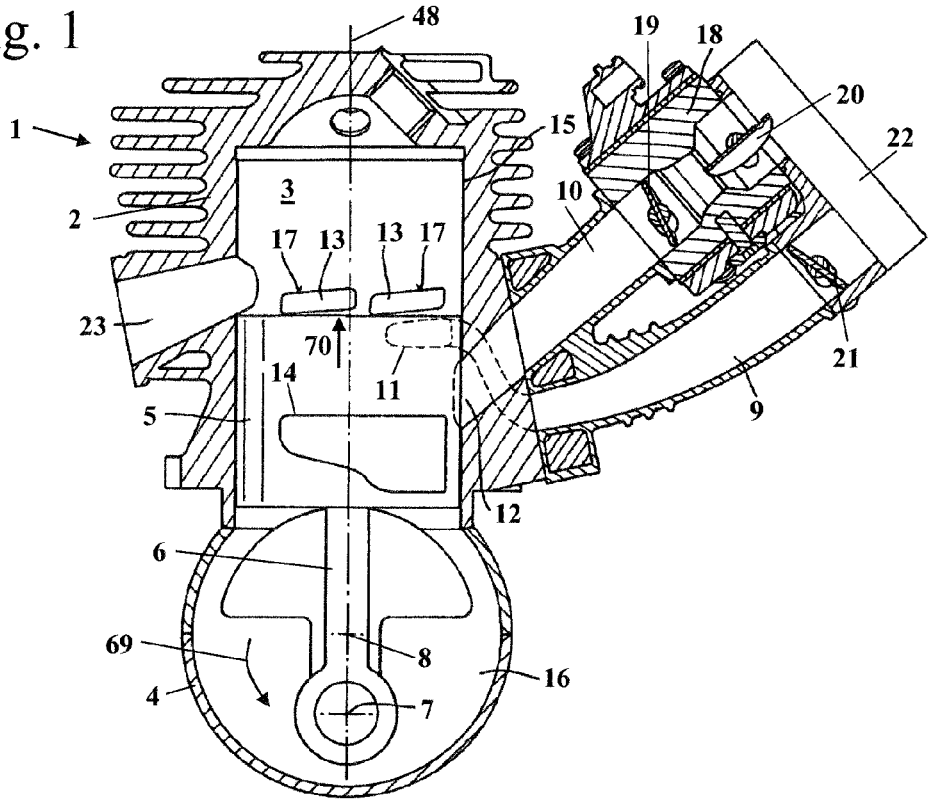
FIG. 1 shows a diagrammatic sectional illustration of a two stroke engine.

FIG. 1 diagrammatically shows one embodiment for a two stroke engine 1. The two stroke engine 1 is configured as a single cylinder engine and has a cylinder 2, in which a combustion chamber 3 is configured. The cylinder 2 has a cylinder longitudinal axis 48. The combustion chamber 3 is delimited by a piston 5 which is mounted so as to move to and fro in a cylinder bore 15 of the cylinder 2 in the direction of the cylinder longitudinal axis 48, in the direction of which the piston 5 moves during operation. FIG. 1 shows the piston 5 at its bottom dead center. The piston 5 drives a crankshaft 7 via a connecting rod 6. The crankshaft 7 is mounted in a crankcase interior 16 of a crankcase 4 such that it can be rotated about a rotational axis 8. During operation, the crankshaft 7 rotates in a rotational direction 69. The two stroke engine 1 can be, for example, the drive motor in a handheld work apparatus, such as a power saw, an angle grinder, a blower device or the like. The crankshaft 7 advantageously serves to drive a tool of the work apparatus. The piston 5 has two piston pockets 14, of which one is shown in FIG. 1. The piston pockets 14 are arranged symmetrically on the piston 5 with respect to the sectional plane in FIG. 1.

The two stroke engine 1 has an air channel 9 which is connected to an air filter 22. Fuel-free or low-fuel advanced scavenging air is fed in via the air channel 9. An air flap 21 for controlling the quantity of advanced scavenging air, which is fed in by the air channel 9, is arranged in the air inlet 9. The air channel 9 opens with an air inlet 11 into the cylinder bore 15. A mixture channel 10 is provided for feeding in fuel/air mixture. The mixture channel 10 is connected via a carburetor 18 to the air filter 22. In the embodiment, a throttle flap 19 and a choke flap 20 are mounted pivotably in the carburetor 18. The throttle flap 19 and the choke flap 20 serve to set the quantity of combustion air and fuel which is fed in via the mixture channel 10. Instead of via a conventional carburetor 18, the fuel can also be fed in in a different way, for example via an injection valve or a carburetor having an electromagnetic valve. The mixture channel 10 opens with a mixture inlet 12 on the cylinder bore 15. The air inlet 11 and the mixture inlet 12 are controlled by the piston 5.

The two stroke engine 1 has transfer channels 13 which open with transfer windows 17 into the combustion chamber 3. The transfer windows 17 are also controlled by the piston 5. In the region of the bottom dead center of the piston 5, the transfer channels 13 (not shown in greater detail) connect the crankcase interior 16 to the combustion chamber 3. During operation, fuel/air mixture is sucked through the mixture inlet 12 into the crankcase interior 16 during the upward stroke of the piston 5. Here, the upward stroke of the piston 5 denotes the movement of the piston 5 out of that position of the piston 5 which is shown in FIG. 1 at the bottom dead center in the direction of the combustion chamber 3, that is, in the direction of the arrow 70 in FIG. 1. In the region of the top dead center of the piston 5, the piston pockets 14 in each case connect an air inlet 11 to transfer windows 17. As a result, advanced scavenging air is sucked out of the air channel 9 into the transfer channels 13. During the upward stroke of the piston 5, mixture which is already present in the combustion chamber 3 is compressed at the same time and is ignited in the region of the top dead center of the piston 5 by a spark plug (not shown).

The combustion pressure accelerates the piston 5 back in the direction of the crankcase 4. An outlet 23 which is likewise controlled by the piston 5 leads out of the combustion chamber 3. As soon as the outlet 23 is opened by the piston 5, the exhaust gases flow out of the combustion chamber 3 through the outlet 23. After a further downward stroke, the piston 5 opens the transfer windows 17 to the combustion chamber 3. The combustion air which is advanced in the transfer channels 13 then flows into the combustion chamber 3. The advanced air flushes exhaust gases out of the combustion chamber 3 through the outlet 23. Fresh fuel/air mixture which has been pre-compressed in the crankcase interior 16 flows in from the crankcase interior 16. During the following engine cycle, the mixture in the combustion chamber 3 is compressed during the upward stroke of the piston 5, while fresh mixture is at the same time sucked into the crankcase interior 16 and advanced scavenging air is sucked into the transfer channels 13.

Figure 2:
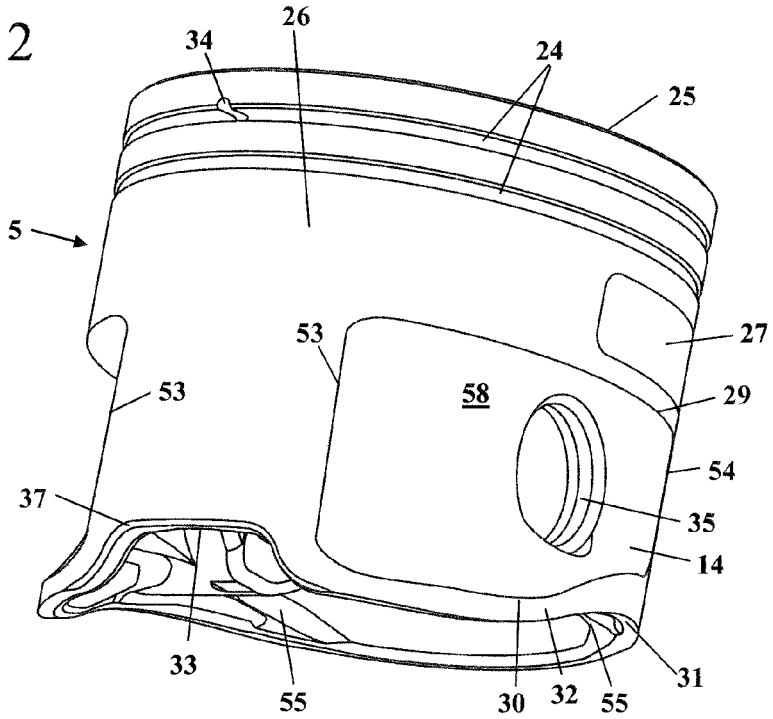
FIG. 2 shows the piston of the two stroke engine from FIG. 1 in a perspective illustration.

The configuration of the piston pockets 14 has a decisive influence on the quantity of advanced scavenging air which is advanced in the transfer channels 13. As FIG. 2 shows, the piston pockets 14 have an upper control edge 29 which, in the region of the top dead center of the piston 5, is advantageously arranged in such a way that the transfer windows 17 are arranged completely in congruence with the piston pocket 14. The upper control edge 29 is that control edge of the piston pocket 14 which lies closest to the combustion chamber 3. Moreover, the piston pocket 14 has a lower control edge 30 which faces the crankcase 4. The lower control edge 30 is that control edge of the piston pocket 14 which lies furthest away from the combustion chamber 3, and delimits the piston pocket 14 in the direction of the crankcase 4. At the top dead center of the piston 5, the lower control edge 30 is advantageously arranged in such a way that the air inlet 11 lies completely in congruence with the piston pocket 14. Moreover, the piston pockets 14 have inlet-near delimitation edges 53 and outlet-near delimitation edges 54. In the embodiment, the delimitation edges 53 and 54 run approximately parallel to the cylinder longitudinal axis 48 (FIG. 1). Therefore, each piston pocket 14 is delimited in the direction of the cylinder longitudinal axis 48 by the control edges 29 and 30 and in the circumferential direction by the delimitation edges 53 and 54. The piston 5 has an edge 31 on its side which faces the crankcase 4, which edge 31 forms that delimitation of the piston 5 which faces the crankcase 4. In each case one web 32 which is formed by a section of a piston skirt 26 is configured between the piston pockets 14 and the edge 31.

The piston 5 has a piston base 25 which runs approximately perpendicularly with respect to the cylinder longitudinal axis 48 and delimits the combustion chamber 3. The piston 5 has the piston skirt 26 which advantageously follows the course of the cylinder bore 15. The outer side of the piston skirt 26 advantageously runs approximately cylindrically. Here, the outer side of the piston skirt 26 can have an exactly cylindrical cross section or a cross section which differs from the circular shape. The piston skirt can have, in particular, an elliptical, oval or cloverleaf-shaped configuration. Here, a cloverleaf-shaped cross section is a cross section, in which the diameter is reduced in two directions which lie obliquely with respect to one another. Here, the deviation of the cross section from the circular shape is advantageously very low. Two piston ring grooves 24 are provided on the piston skirt 26 adjacently with respect to the piston base 25, which piston ring grooves 24 serve to receive piston rings. A bore 34 is shown in one of the piston ring grooves 24, which bore 34 serves to receive a securing pin for a piston ring. A corresponding bore (not visible in FIG. 2) is also provided in the other piston ring groove 24. As FIG. 2 also shows, a deepening 27 is provided on the piston skirt 26 between each piston pocket 14 and the piston ring grooves 24. The depression 27 serves to reduce the weight of the piston 5. Here, the deepening 27 is configured in such a way that, during a piston stroke, it lies in congruence only with one or both transfer windows 17, but not with the air inlet 11. On the side which faces the mixture inlet 12, the piston skirt 26 has a recess 33 on the side which faces the crankcase 4 and lies at a distance from the combustion chamber 3. The height of the piston skirt 26 is reduced at the recess 33. The recess 33 is configured as an indentation of the edge 31 in the direction of the piston base 25. The position of the edge 31 on the recess 33 fixes the control time, at which the mixture inlet 12 is opened and closed. A chamfer 37 is provided on the edge 31 in the region of the recess 33, at the transition of the edge 31 to the outer side of the piston skirt 26.

The connecting rod 6 (FIG. 1) is connected to the piston 5 via a piston pin (not shown). The piston pin is held on the piston 5 in piston pin receptacles 35. In the embodiment, the piston pin receptacles 35 are arranged completely in the piston pockets 14. The piston pin receptacles 35 are advantageously situated in the space between the control edges 29 and 30 of the piston pockets 14. The piston pocket 14 is delimited by a rear wall 58 toward the crankcase interior.

Figure 3:
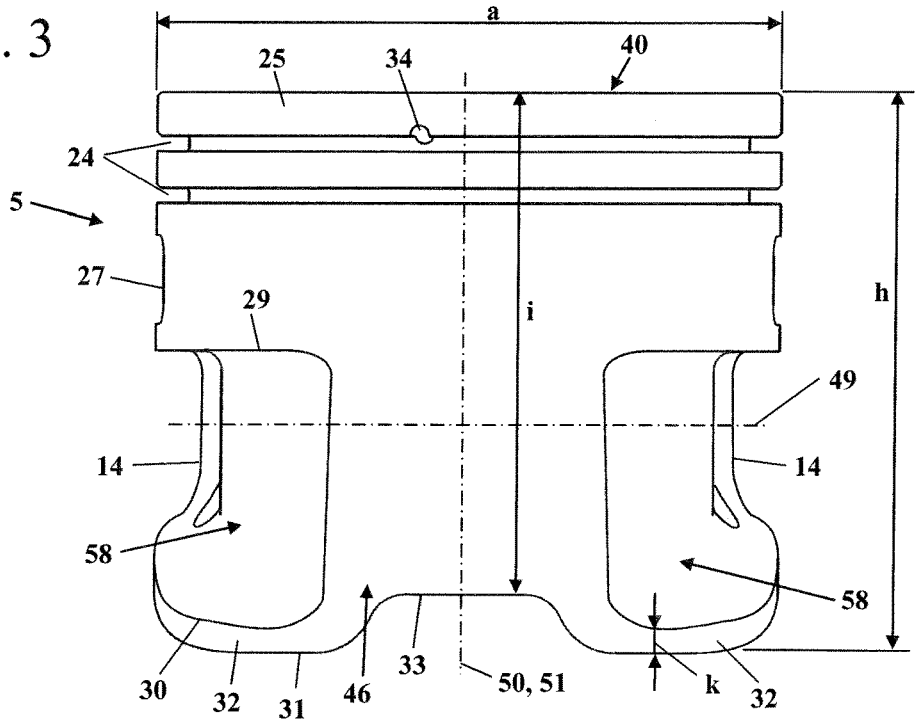
FIG. 3 shows a side view of the piston.

As FIG. 3 shows, the piston 5 has a diameter a. The diameter a is advantageously the greatest diameter of the piston 5 and, in the embodiment, is measured on a top side 40 of the piston base 25. Here, the top side 40 of the piston base 25 is that side of the piston base 25 which delimits the combustion chamber 3. The piston 5 has a height h which is measured parallel to a longitudinal center axis 50 of the piston 5. The height h is the greatest height of the piston 5. The longitudinal center axis 50 of the piston 5 is the center axis of the piston skirt 26. In the case of the arrangement of the piston 5 in the cylinder 2, the longitudinal center axis 50 of the piston 5 coincides approximately with the cylinder longitudinal axis 48. The piston pin receptacles 35 (FIG. 2) have a center axis which forms a transverse axis 49 of the piston 5. In the side view which is shown, the transverse axis 49 runs perpendicularly with respect to the longitudinal center axis 50. The piston 5 has a center plane 51 which contains the longitudinal center axis 50 of the piston 5 and which runs perpendicularly with respect to the transverse axis 49. In the side view which is shown in FIG. 3, the longitudinal center axis 50 and the center plane 51 coincide. The piston 5 has a reduced height i at the recess 33. The reduced height i is the spacing of the edge 31 on the recess 33 from the top side 40 of the piston 5, which spacing is measured parallel to the longitudinal center axis 50. The reduced height i at the recess 33 is advantageously from 70% to 98%, in particular from 80% to 95% of the height h of the piston 5. The diameter a is advantageously from 70% to 140% of the height h, in particular from 80% to 130%, preferably from 90% to 120% of the height h. The diameter a is particularly preferably greater than the height h.

The piston 5 has an inlet side 46, on which the recess 33 is arranged. FIG. 3 shows a side view of the inlet side 46. The web 32 between the piston pocket 14 and the edge 31 has a minimum height k on the inlet side 46. In the embodiment, the minimum height k is measured on that circumferential region of the piston pocket 14 which faces the recess 33. The minimum height k can be from approximately 1 mm to approximately 5 mm, in particular from approximately 1 mm to approximately 3 mm. Here, the height of the web 32 does not have to be constant, but rather can vary along the circumference of the piston 5. The web 32 serves for sealing between the volume which is enclosed by the piston pocket 26 and the cylinder bore 15 and the crankcase interior 16.

Figure 4:
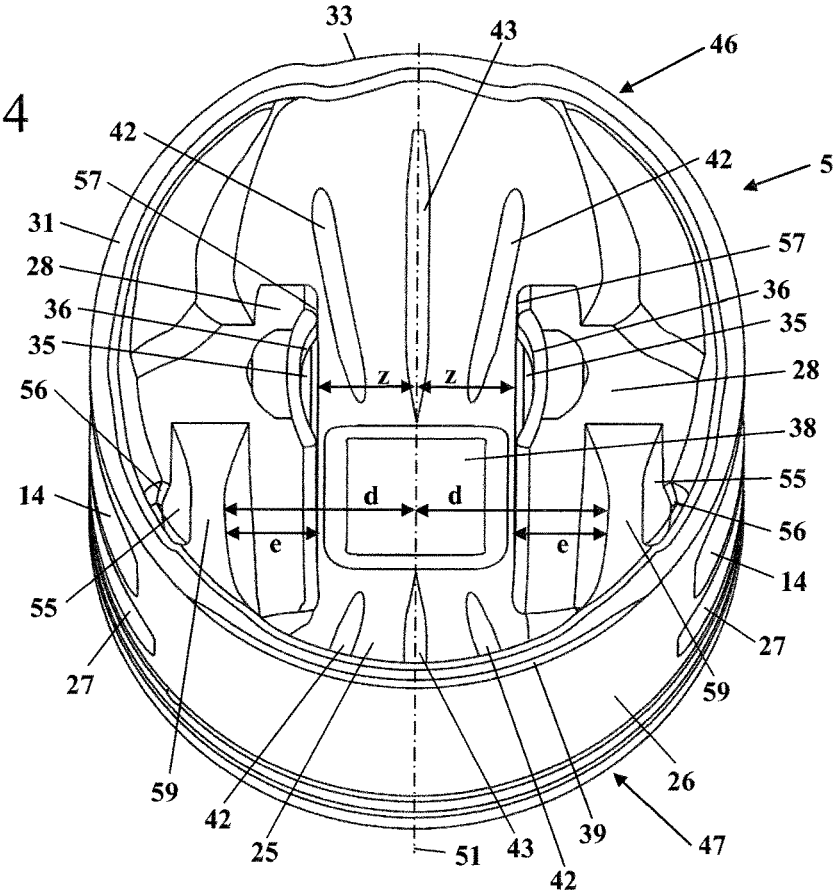
FIG. 4 shows a perspective illustration of the piston from the side which faces the crankcase.

FIG. 4 shows the interior of the piston 5. The piston pin receptacles 35 are configured on piston pin eyes 28 which extend as far as the piston base 25 in the embodiment. The piston pin eyes 28 have end sides 57 which face one another. In the embodiment, the end sides 57 run approximately parallel to the center plane 51. In one advantageous configuration, the end sides 57 of the two piston pin eyes 28 run in an approximately mirror-symmetrical manner with respect to one another in relation to the center plane 51. Small pull-out bevels are advantageously provided on all faces of the piston 5 which run approximately parallel to the longitudinal center axis 50 of the piston 5, in order that the piston 5 can be demolded during the production in a casting process. The pull-out bevels on the faces which run approximately parallel to the center plane 51 can be, for example, from 0.5° to 3°. The end sides 57 of the piston pin eyes 28 are those regions of the piston pin eyes 28 which are at the smallest spacing from the center plane 51. The piston pin receptacles 35 end on the end sides 57. In the embodiment, the end sides 57 are in each case at a spacing z from the center plane 51, which spacing z is measured perpendicularly with respect to the center plane 51 and parallel to the transverse axis 49 (FIG. 3). The spacing z is advantageously at least 5%, in particular at least 10% of the diameter a of the piston 5 (FIG. 3). The piston pin eyes 28 are advantageously arranged symmetrically with respect to the center plane 51, which results in the same spacing z for both ends sides 57. On the side which faces away from the combustion chamber 3, the end sides 57 have an indentation 36 which extends as far as the piston pin receptacle 35 and at which the spacing from the center plane 51 is increased. The indentation 36 serves to lubricate a piston pin bearing, by way of which the piston pin is mounted on the connecting rod 6 (FIG. 1).

In the embodiment, the end sides 57 of the piston pin eyes 28 are in each case at a spacing e from the connecting ribs 55, which spacing e is measured perpendicularly with respect to the center plane 51 and parallel to the transverse axis 49 (FIG. 3). The spacing e is advantageously at least 5%, in particular at least 10% of the diameter a of the piston 5 (FIG. 3). The piston pin eyes 28 and the connecting ribs 55 are advantageously arranged symmetrically with respect to the center plane 51, which results in the same spacing e on both sides of the center plane 51 between an end side 57 and the connecting rib 55 which is arranged on the same side of the center plane 51.

The piston 5 has the inlet side 46 which is arranged at the top in the illustration in FIG. 4 and on which the recess 33 is provided on the piston skirt 26, and an outlet side 47. The piston 5 is divided into the inlet side 46 and the outlet side 47 by a transverse plane 52 which is shown diagrammatically in FIG. 5. The transverse plane 52 is spanned by the longitudinal center axis 50 of the piston 5 and the transverse axis 49.

As FIG. 4 shows, the connecting pin eyes 28 are connected to the piston skirt 26 via connecting ribs 55. Here, the connecting ribs 55 extend on that side of the piston pin eyes 28 which faces away from the recess 33. In the installed state, the connecting ribs 55 are arranged on that side of the cylinder 2 which faces away from the mixture inlet 12 and faces the outlet 23 (FIG. 1). The connecting ribs 55 are arranged on the outlet side 47 of the piston 5. As FIG. 4 also shows, a chamfer 39 is also configured on that side of the edge 31 of the piston skirt 26 which faces the outlet 23.

In each case one deepening 56 is configured between the connecting ribs 55 and the piston skirt 26. Each deepening 56 extends between the connecting rib 55 and the piston skirt 26 on that side of the connecting rib 55 which faces away from the center plane 51. The spacing of the deepening 56 from the center plane 51 is greater than the spacing of the connecting rib 55 which delimits the deepening 56 from the center plane 51. The connecting ribs 55 are at a spacing d from the center plane 51. Here, the spacing d can vary in different regions of the connecting rib 55, for example if the width of the connecting rib 55 is not constant. A greater width of the connecting rib 55 is preferably provided in the attachment region to the piston pin eye 28 and in the attachment region to the piston skirt 26. The spacing d is advantageously measured in a central region of the connecting rib 55. The spacing d is advantageously at least 20%, in particular at least 25% of the diameter a of the piston 5. The spacing d at every point of the connecting rib 55 is particularly preferably at least 20%, in particular at least 25% of the diameter a of the piston 5. As FIG. 4 shows, both connecting ribs 55 advantageously run in a mirror-symmetrical manner with respect to one another in relation to the center plane 51. The connecting ribs 55 preferably run parallel to the center plane 51.

As FIG. 4 shows, ribs 42 and 43 run between the piston base 25 and the piston skirt 26 both on the inlet side 46 and on the outlet side 47. The ribs 42, 43 connect the piston skirt 26 and the piston base 25 and bear directly against the piston skirt 26 and respectively against the piston base 25 over their entire length. In each case one central rib 43 is provided both on the inlet side 46 and on the outlet side 47, which central rib 43 runs along the center plane 51 and is intersected centrally by the center plane 51. Lateral ribs 42 are provided on both sides of the central rib 43. Here, precisely one lateral rib 42 is arranged on each side of the central rib 43. As FIG. 4 also shows, a stop face 38 is configured in the region between the piston pin eyes 28 on the piston base 25. The stop face 38 serves for defined positioning of the piston 5 during machining of the piston skirt 26.

Figure 5:
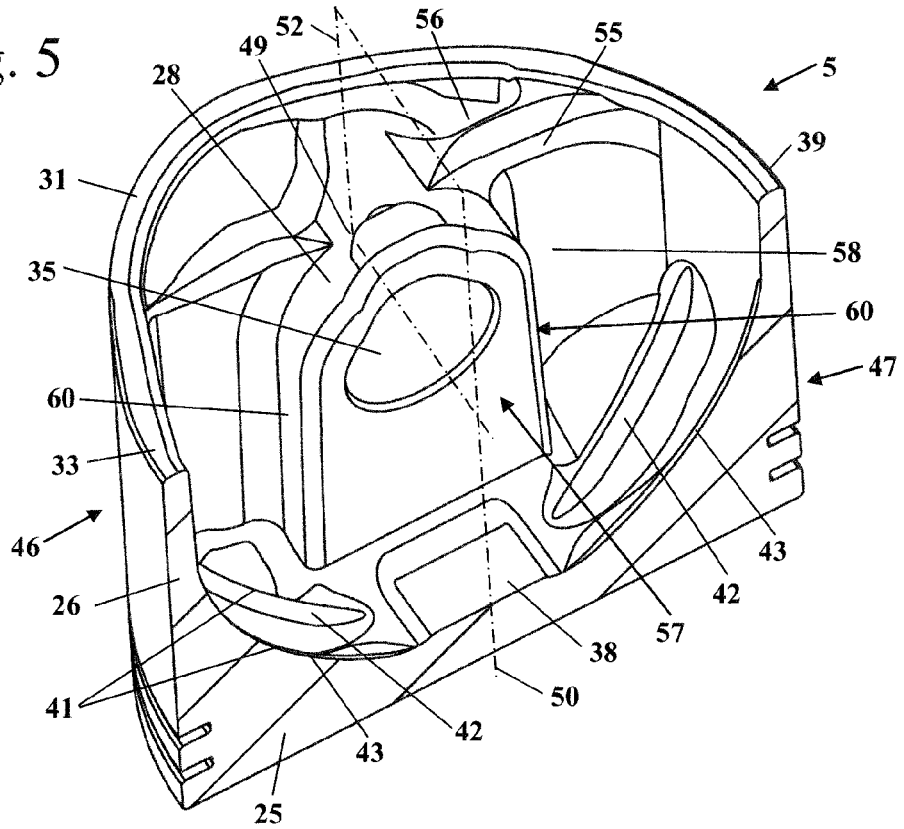
FIG. 5 shows a perspective illustration of a section through the piston along the center plane.

As the sectional illustration in FIG. 5 shows, the ribs 42 and 43 in each case connect the piston skirt 26 to the piston base 25. The ribs 42 and 43 on the inlet side 46 are advantageously arranged symmetrically with respect to the ribs 42 and 43 on the outlet side 47 in relation to the transverse plane 52. Those end sides 41 of the ribs 42 and 43 which protrude into the interior of the piston 5 advantageously run in a curved manner, namely concavely. The ribs 42 and 43 are not connected to one another directly. The ribs 42 and 43 are also at a spacing from the piston pin eyes 28. Accordingly, there is no direct connection between the ribs 42 and 43 and the piston pin eyes 28. The ribs 42 and 43 are configured separately from the piston pin eyes 28. The connecting rib 55 is also not connected directly to the ribs 42 and 43. As FIG. 5 shows, the connecting ribs 55 lie in an extension of the rear wall 58 of the piston pocket 14. As FIG. 5 also shows, the piston pin eyes 28 have in each case two side surfaces 60 which run with a small pull-out bevel approximately parallel to the transverse plane 52 of the piston 5. The piston 5 can be clamped on the side surfaces 60 for the machining of the piston skirt 26.

Figure 6:
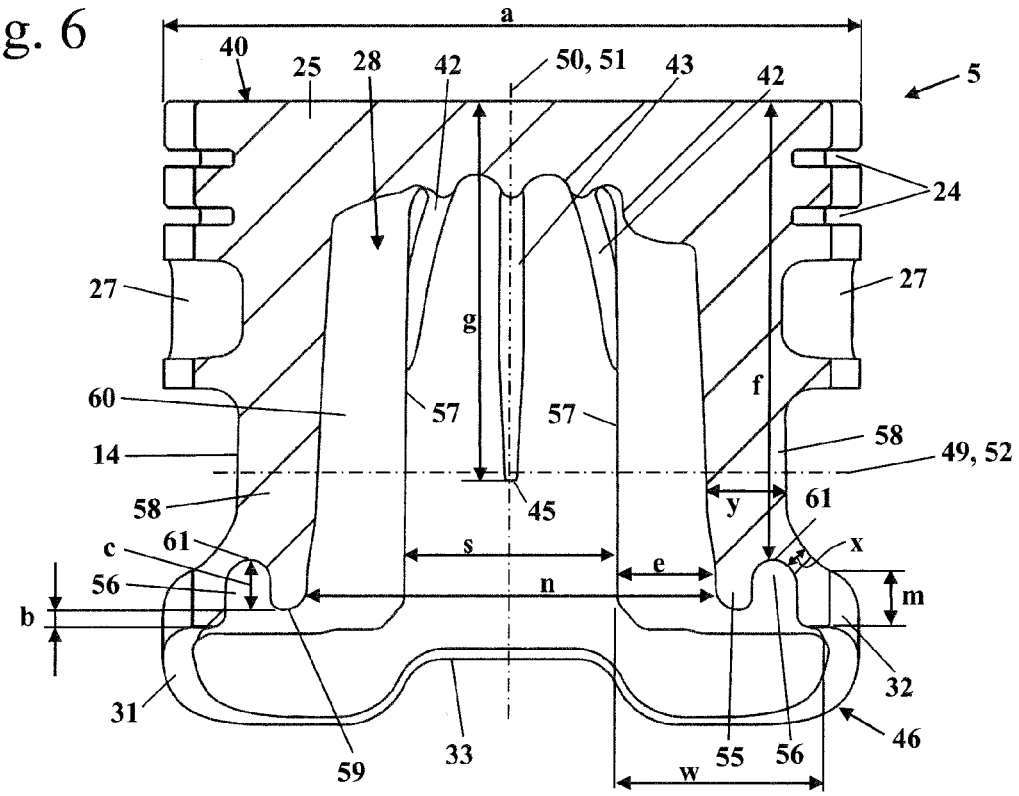
FIG. 6 shows a section through the piston perpendicularly with respect to the center plane and parallel to the longitudinal center axis through the connecting rib with a viewing direction toward the inlet side of the piston.

As FIG. 6 shows, the connecting ribs 55 have an end side 59 of the connecting ribs 55, which end side 59 faces away from the top side 40 of the piston 5. The end sides 59 are also shown in FIG. 4. The end side 59 of the connecting rib 55 faces the crankcase 4 in the installed state. The deepening 56 has a maximum depth c which is measured parallel to the longitudinal center axis 50 as far as the end side 59 of the connecting rib 55. The maximum depth c is advantageously at least 3%, in particular at least 5% of the height h of the piston 5. The maximum depth c is advantageously less than 20%, in particular less than 10% of the height h of the piston 5. In one particularly advantageous configuration, the depth of the deepening 56 at every position of the deepening 56 is at least 3%, in particular at least 5% of the height h of the piston 5. In one particularly advantageous configuration, the depth of the deepening 56 at every point of the deepening 56 is less than 20%, in particular less than 10% of the height h of the piston 5. With respect to the edge 31, the end side 59 has an offset b which is measured parallel to the longitudinal center axis 50. The offset b is advantageously less than 5%, in particular less than 3% of the height h of the piston 5. The offset b can also be zero. An offset b of more than 1% of the height h of the piston 5 is particularly advantageously provided. The end side 59 is advantageously arranged closer to the top side 40 of the piston 5 than the edge 31 in the region of the deepening 56. The maximum depth c is advantageously considerably greater than the offset b. The maximum depth c is advantageously at least twice the offset b. In the region which delimits the deepening 56, the web 32 has a height m which is measured parallel to the longitudinal center axis 50 and is greater than the smallest height k of the web 32 shown in FIG. 3. The height m is advantageously at least 1.5 times the height k.

The deepening 56 has a base 61 which is that region of the deepening 56 which is at the smallest spacing from the top side 40 of the piston 5. The base 61 of the deepening 56 is at a spacing f from the base 40 of the piston 5, which spacing f is measured parallel to the longitudinal center axis 50 and is advantageously more than 50%, in particular more than 60% of the height h of the piston 5. The spacing f is advantageously less than 90% of the height h of the piston 5.

The rear wall 58 of the piston pocket 14 has a wall thickness y between the piston pocket 14 and the interior of the piston 5, which interior lies between the rear walls 58 of the piston pockets 14. In the region between the deepening 56 and the piston pocket 14, the rear wall 58 has a reduced wall thickness x. The reduced wall thickness x is advantageously at most 80%, in particular at most 60% of the wall thickness y. The wall thickness x must not undershoot a minimum dimension for sufficient stability of the rear wall 58. The minimum dimension which is dependent on the material and the geometry of the piston 5 determines the maximum possible depth c of the deepening 56.

As FIG. 6 also shows, the central rib 43 has an end 45 which faces away from the top side 40 of the piston 5. The end 45 is at a spacing g from the top side 40. The spacing g is advantageously from approximately 30% to approximately 60% of the height h of the piston 5. The spacing g is advantageously smaller than the spacing f of the base 61 of the deepening 56 from the top side 40 of the piston 5. The spacing g is advantageously less than 90%, in particular less than 80% of the spacing f.

The connecting ribs 55 which are arranged on the opposite sides of the center plane 51 are at a spacing n from one another, which spacing n is measured perpendicularly with respect to the center plane 51. The spacing n is advantageously at least 40%, in particular at least 50% of the diameter a of the piston 5. The end sides 57 of the piston pin eyes 28 are at a spacing s from one another. The spacing s is advantageously at least 10%, in particular at least 20% of the diameter a of the piston 5. The spacing s is considerably smaller than the spacing n of the connecting ribs 55. The spacing s is advantageously less than 70% of the spacing n. The connecting ribs 55 are offset radially to the outside with respect to the end sides 57. The piston pin eyes 28 have a width w which is measured from the end sides 57 to the piston skirt 26 and perpendicularly with respect to the center plane 51, which width w is advantageously at least 15%, in particular at least 20% of the diameter a of the piston.

Figure 7:
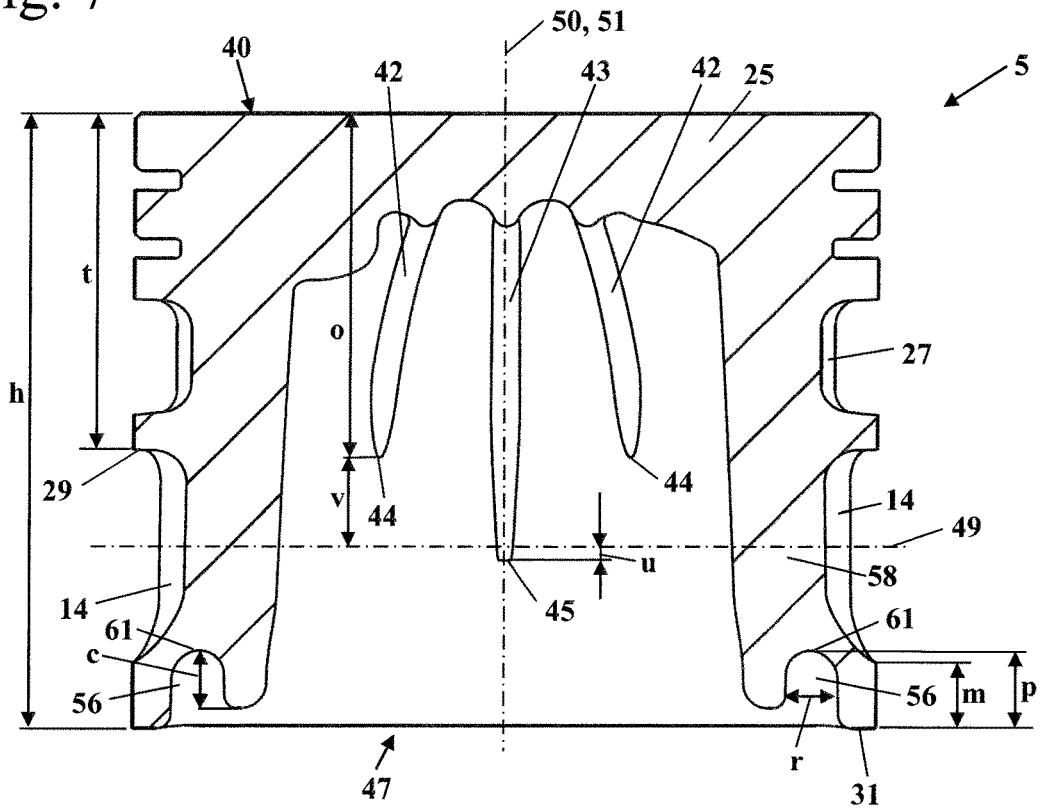
FIG. 7 shows a section along the sectional plane which is shown in FIG. 6, with a viewing direction toward the outlet side of the piston; and, FIG. 8 shows a diagrammatic view of one embodiment of a piston from the side which faces the crankcase.

As FIG. 7 shows, in the side view which is shown, the end 45 of the central rib 43 is at a spacing u from the transverse axis 49, which spacing u is measured parallel to the longitudinal center axis 50. In the embodiment, the end 45 is further away from the top side 40 than the transverse axis 49. It can also be provided, however, that the end 45 is arranged closer to the top side 40 than the transverse axis 49. The spacing u is advantageously less than 10% of the height h of the piston 5.

The lateral ribs 42 have an end 44 which faces away from the top side 40 and is at a spacing o from the top side 40, which spacing o is measured parallel to the longitudinal center axis 50. The spacing o is smaller than the spacing g between the end 45 of the central rib 43 and the top side 40 of the piston 5 (FIG. 6). In the side view which is shown, the end 44 is at a spacing v from the transverse axis 49, which spacing v is considerably greater than the spacing u of the end 45 from the transverse axis 49. The spacing v is advantageously from 5% to 20% of the height h of the piston 5. As FIG. 7 also shows, the upper control edge 29 of the piston pockets 14 is at a spacing t from the top side 40, which spacing t is advantageously from 30% to 60% of the height h of the piston 5. The end 44 lies approximately at the height of the control edge 29.

The deepening 56 has a width r which is measured parallel to the transverse axis 49 and is advantageously less than 10% of the diameter a of the piston 5. The base 61 is at a spacing p from the edge 31 in the region which delimits the deepening 56, which spacing p is measured parallel to the longitudinal center axis 50. In the embodiment, the spacing p is greater than the height m of the web 32 in this region. The height m of the web 32 is advantageously from 70% to 95% of the spacing p. The width r of the deepening 56 can correspond approximately to the maximum depth c of the deepening 56. The width r is preferably from 60% to 120% of the maximum depth c of the deepening 56 (FIG. 6).

Figure 8:
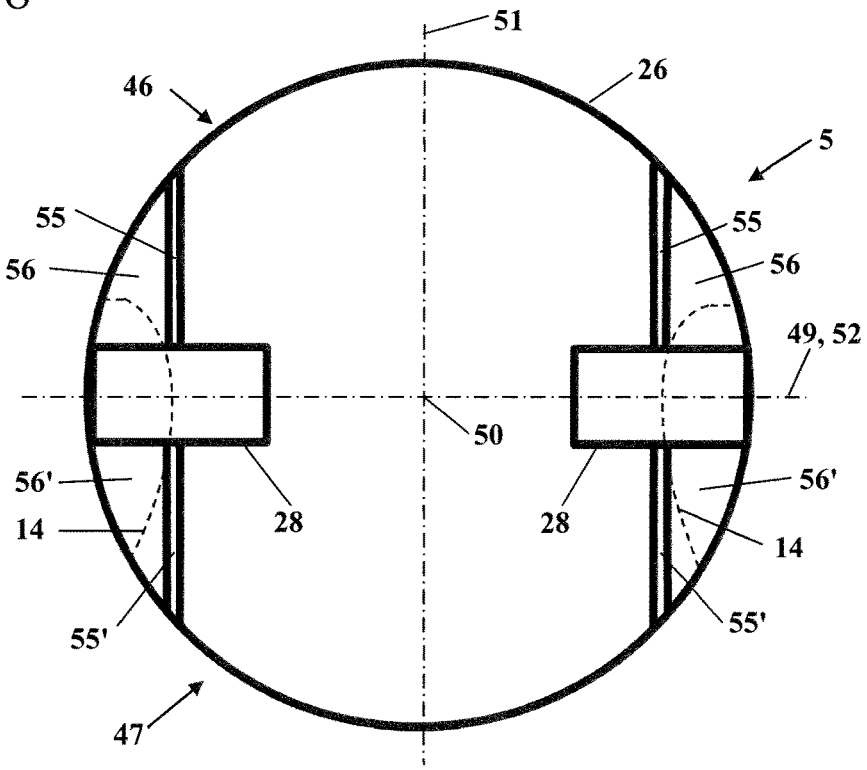

FIG. 8 shows a diagrammatic illustration of one embodiment for a piston 5. Here, identical designations denote elements which correspond to one another in all figures. On the inlet side 46, the piston 5 which is shown in FIG. 8 has two connecting ribs 55 which run in each case between a piston pin eye 28 and the piston skirt 26, and which delimit a deepening 56. The connecting ribs 55 and the deepenings 56 are configured as described with respect to the preceding embodiment. Connecting ribs 55' are provided on the outlet side 47, which connecting ribs 55' connect in each case one piston pin eye 28 to the piston skirt 26. The connecting ribs 55' are configured in a corresponding manner with respect to the connecting ribs 55. A deepening 56' is arranged between the connecting ribs 55' and the piston skirt 26, in each case on the side which faces away from the center plane 51. The deepenings 56' are configured in a corresponding manner with respect to the deepenings 56. The connecting ribs 55 and the connecting ribs 55' are advantageously arranged and configured in a mirror-symmetrical manner with regard to the transverse plane 52. The deepenings 56' can also be configured in a mirror-symmetrical manner with respect to the deepenings 56. It can also be provided, however, that the depth and/or shape of the deepenings 56 differ/differs from the depth and/or shape of the deepenings 56. This can result, in particular, from a shape of the piston pockets 14 which is asymmetrical with respect to the transverse plane 52. As shown in FIG. 8, the connecting ribs 55' and the deepenings 56' can be provided in addition to the connecting ribs 55 and the deepenings 56'. It can also be provided, however, that connecting ribs 55' and deepenings 56' are arranged only on the outlet side 47 of the piston 5, and no connecting ribs 55 and deepenings 56 are arranged on the inlet side 46.

The piston 5 is made of light metal, in particular of magnesium. A configuration from aluminum can also be advantageous. The deepenings 56, 56' avoid a material accumulation between the connecting rib 55, 55' and the piston skirt 26, with the result that the piston 5 can be produced satisfactorily in a casting process from light metal, in particular from magnesium.

It is understood that the foregoing description is that of the preferred embodiments of the invention and that various changes and modifications may be made thereto without departing from the spirit and scope of the invention as defined in the appended claims.

What is claimed is:

1. A piston for a two-stroke engine operating with advanced scavenging, the piston comprising:
- a piston base;
- a piston skirt;
- said piston skirt defining a first center axis;
- said first center axis forming a longitudinal center axis of the piston;
- the piston having two piston pin eyes defining a second center axis;
- said second center axis defining a transverse axis;
- said two piston pin eyes having piston pin receptacles formed therein;
- the piston defining a middle plane containing said longitudinal center axis of the piston;
- said middle plane being perpendicular to said transverse axis;
- the piston having at least one piston pocket;
- at least one connecting rib connecting at least one of said two piston pin eyes to said piston skirt;
- said piston defining an inner space enclosed by said piston skirt;
- said at least one connecting rib running within said inner space of said piston;
- said at least one piston pocket having a first side being disposed in spaced relationship to said piston base; and,
- said at least one connecting rib being arranged on said first side of said piston pocket.

2. The piston of claim 1, wherein a deepening is formed between said at least one connecting rib and said piston skirt.

3. The piston of claim 2, wherein:
- said deepening has a depth (c);
- the piston has a height (h); and,
- said depth (c) is at least 3% of said height (h).

4. The piston of claim 1, wherein said at least one connecting rib runs parallel to said middle plane.

5. The piston of claim 1, wherein:
- the piston has a diameter (a);
- said at least one connecting rib and said middle plane conjointly define a distance (d) therebetween; and,
- said distance (d) is at least 20% of said diameter (a).

6. The piston of claim 1, wherein:
- the piston has a diameter (a);
- each of said piston pin eyes has an end face;
- said end faces of said piston pin eyes face each other;
- said at least one connecting rib defines a distance (e) to a corresponding one of said end faces, said distance (e) being measured parallel to said transverse axis; and,
- said distance (e) is at least 5% of said diameter (a).

7. The piston of claim 1, wherein said piston pocket has a rear wall and said at least one connecting rib is arranged in an extension of said rear wall.

8. The piston of claim 1, wherein said piston skirt has an edge facing away from said piston base.

9. The piston of claim 8, wherein:
- said at least one connecting rib has an end face facing away from said at least one piston pocket;
- said end face and said edge define an offset (b) therebetween;
- the piston has a height (h);
- said offset (b) in the direction of the longitudinal center axis is less than 5% of said height (h) at every location of said end face.

10. The piston of claim 8, wherein a deepening is formed between said at least one connecting rib and said piston skirt, the piston further comprising:
- a web extending between said edge and said at least one piston pocket;
- said web having a height (m) in a circumferential area of the piston in which said deepening is disposed;
- said web has a smallest height (k); and,
- said height (m) is at least 1.5 times said smallest height (k).

11. The piston of claim 1, wherein said piston pin receptacles are at least partially arranged in said at least one piston pocket.

12. A piston for a two-stroke engine operating with advanced scavenging, the piston comprising:

a piston base;

a piston skirt;

said piston skirt defining a first center axis;

said first center axis forming a longitudinal center axis of the piston;

the piston having two piston pin eyes defining a second center axis;

said second center axis defining a transverse axis;

said two piston pin eyes having piston pin receptacles formed therein;

the piston defining a middle plane containing said longitudinal center axis of the piston;

said middle plane being perpendicular to said transverse axis;

the piston having a first piston pocket and a second piston pocket;

said first piston pocket and said second piston pocket are disposed on opposite sides of said middle plane;

a first connecting rib connecting one of said two piston pin eyes to said piston skirt and a second connecting rib connecting the other one of said two piston pin eyes to said piston skirt;

said first piston pocket and said second piston pocket each having a first side disposed in spaced relationship to said piston base; and, said first connecting rib being arranged at said first piston pocket on said first side of said first piston pocket and said second connecting rib being arranged at said second piston pocket on said first side of said second piston pocket.

13. The piston of claim 1, wherein the piston is made of a light metal.

14. A two-stroke engine comprising:

a piston having a piston pocket;

a cylinder having a cylinder bore;

a combustion chamber formed in said cylinder bore and delimited by said piston;

a crankcase defining a crankcase interior;

a crankshaft rotatably mounted in said crankcase;

said piston being configured to drive said crankshaft;

a transfer channel configured to connect said crankcase interior to said combustion chamber in at least one position of said piston;

an air channel configured for supplying advanced scavenging air;

said air channel opening at said cylinder bore with an air inlet;

said transfer channel having a transfer window; and, said piston pocket being configured to lie so as to at least partially overlap with said air inlet and said transfer window in at least one position of said piston.

15. A piston for a two-stroke engine operating with advanced scavenging, the piston comprising:

a piston base;

a piston skirt;

said piston defining an inner space enclosed by said piston skirt;

said piston skirt defining a first center axis;

said first center axis forming a longitudinal center axis of the piston;

the piston having two piston pin eyes defining a second center axis;

said second center axis defining a transverse axis of the piston;

said two piston pin eyes having piston pin receptacles formed therein;

the piston defining a middle plane containing said longitudinal center axis of the piston;

said middle plane being perpendicular to said transverse axis;

the piston having at least one piston pocket;

at least two ribs extending in said inner space of said piston between said piston base and said piston skirt;

the piston having a top side;

said at least two ribs including a first rib having a first end facing away from said top side;

said first end being at a first distance (g) from said top side;

said at least two ribs including a second rib having a second end facing away from said top side;

said second end being at a second distance (o) from said top side measured parallel to said longitudinal center axis of the piston; and, said distance (o) being smaller than said distance (g).

16. The piston of claim 15, wherein:

the piston has an inlet side and an outlet side;

at least one of said at least two ribs extends at said outlet side; and, at least one of said at least two ribs extends at said inlet side.

17. The piston of claim 16, wherein:

the piston has two first ribs;

one of said two first ribs is disposed at said inlet side and another one of said two first ribs is disposed at said outlet side;

each of said two first ribs extends along said middle plane and is centrally intersected by said middle plane;

the piston has a plurality of second ribs; and, said two first ribs each have a second rib disposed on either side thereof.

* * * * *